United States Patent [19]

Rhodes et al.

[11] Patent Number: 4,627,595

[45] Date of Patent: Dec. 9, 1986

[54] ICE CONTAINER HAVING COILED STRIP PARTITION

[76] Inventors: Ronny Q. Rhodes, 16 Oakwood Ct., Tuscaloosa, Ala. 35402; Jack W. Duke, 429 21st St., Suite 4, Tuscaloosa, Ala. 35401

[21] Appl. No.: 709,421

[22] Filed: Mar. 7, 1985

[51] Int. Cl.[4] ..... F25C 1/04; F25C 1/24

[52] U.S. Cl. ..... 249/121; 220/22; 249/126; 249/128; 249/131; 249/134; 249/203; D15/90

[58] Field of Search ..... 249/119, 120, 121, 126, 249/127, 128, 129, 130, 203, 131, 134; 220/20, 22; 426/515, 524; D7/78, 79, 81; D15/80, 90

[56] References Cited

U.S. PATENT DOCUMENTS

| | | | |
|---|---|---|---|
| 15,363 | 7/1856 | Wickersham | 210/494.2 |
| 1,807,587 | 6/1931 | Copeman | 249/126 |
| 2,955,044 | 10/1960 | Tupper | 249/127 |
| 3,565,389 | 2/1971 | Price | 249/128 |
| 4,223,043 | 9/1980 | Johnson | 249/127 |
| 4,320,846 | 3/1982 | Meyering et al. | 220/23.8 |

*Primary Examiner*—Jay H. Woo
*Assistant Examiner*—James C. Housel
*Attorney, Agent, or Firm*—Nies, Webner, Kurz & Bergert

[57] ABSTRACT

A portable ice maker and container capable of utilizing available freezer space to provide additional ice-making capacity is disclosed. In one embodiment, the device includes a bucket-shaped vessel having a plurality of coiled strips arranged in a vertical stack with adjacent strips separated by a partition member, each coiled strip being in a horizontal position with the curvature of the coils arranged so as to be generally concentric with the central vertical axis of the vessel. A plurality of transverse ribs are attached at intervals along the length of each strip for use in defining the shape of the individual ice cubes.

12 Claims, 7 Drawing Figures

ICE CONTAINER HAVING COILED STRIP PARTITION

BACKGROUND AND SUMMARY OF THE INVENTION

The present invention relates to a portable ice maker and container. More particularly, the present invention relates to a receptacle for use in the production and storage of ice cubes, including a cylindrical container having at least one coiled strip contained therein, and with the coiled strip having a plurality of transverse segments for use in forming ice cubes.

In the manufacture of ice cubes for use by consumers in the home as well as in restaurants and other similar environments, there has been a need for additional ice making capacity in a unit having a compact configuration and with the ice cubes when formed being easily releasable and readily available for use.

By the present invention, there is provided an ice maker and container having the above mentioned features, being of a convenient shape and configuration so as to utilize available freezer space or other similar water freezing environment and to provide substantial additional ice cubes for use in the home or other location. The ice maker and container of the present invention is advantageously formed in a cylindrical bucket-like shape, and with a plurality of horizontal layers of coiled strips being stacked in the container for use in defining the ice cube configurations. Adjacent coiled strips are separated by a flat plate member and each coiled strip is provided with a series of transverse planar fins or ribs at intervals along the length of the strip for use in defining the shape of the individual ice cubes.

In one embodiment, the transverse fins are of increasing length as measured outwardly from the coiled strip, from one end of the coiled strip to the other. The inner end of the coiled strip is provided with an interlocking flange member to assist in maintaining the strip in the coiled configuration.

The present invention is distinguished over the freezing container as described in U.S. Pat. No. 1,807,587 to Copeman, wherein a tray with vertical partitions is disclosed, but without the coiled strip for defining the ice cubes as in the present invention. The present invention is also distinguished over the receptacles as described in U.S. Pat. No. 2,955,044 to Tupper, wherein a coiled strip with ice cube-containing receptacles is disclosed, but without the features of the invention whereby ribs are attached transversely to a coiled strip, said ribs together with a portion of the coiled strip defining a series of vertical enclosures, open at the top, for receiving water which is frozen to form ice cubes.

DESCRIPTION OF THE PREFERRED EMBODIMENTS

Figure 1:
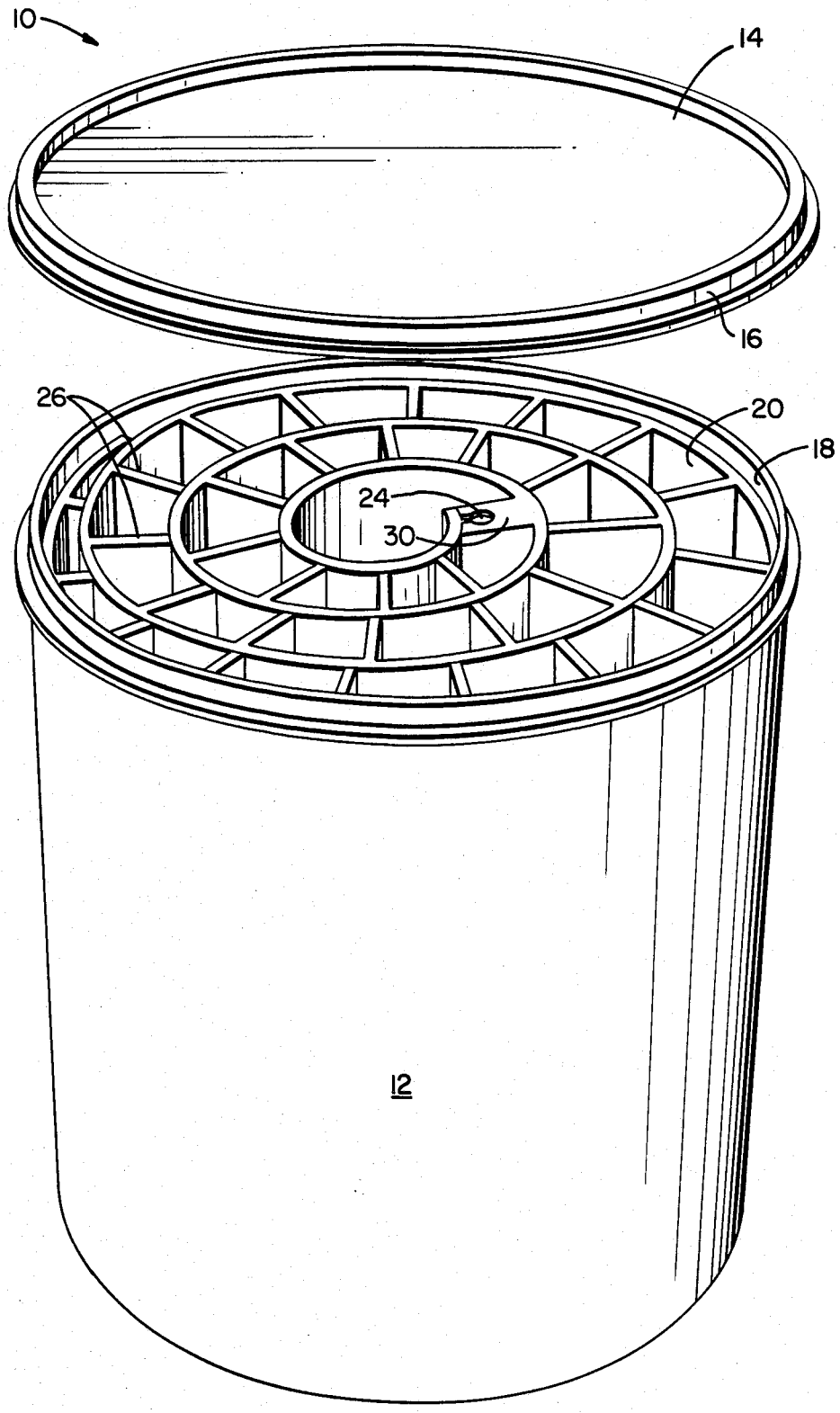
FIG. 1 is a front perspective view of the ice maker and container of the present invention.

In the embodiment of the invention as shown in FIGS. 1–7, there is provided an ice maker and container 10 which includes a generally cylindrical bucket-shaped receptacle or vessel 12. A lid 14 is provided for the container 10, and the vessel 12 and lid 14 may be formed of a suitable plastic material having conventional releasable sealing means 16, 18 on the respective outer portions of the lid 14 and upper end portion of the vessel 12.

Located within the container 10 are a plurality of horizontal coiled strips 20 with adjacent strips 20 separated by a horizontal plate member 22 which serves as a partition. The coiled strips 20 and partition member 22 may also be made of a suitable plastic material such as polyethylene or similar material. The strips 20 and partition member 22 are constructed as separate units which may be easily inserted into or removed from the vessel 12 as desired.

Figure 2:
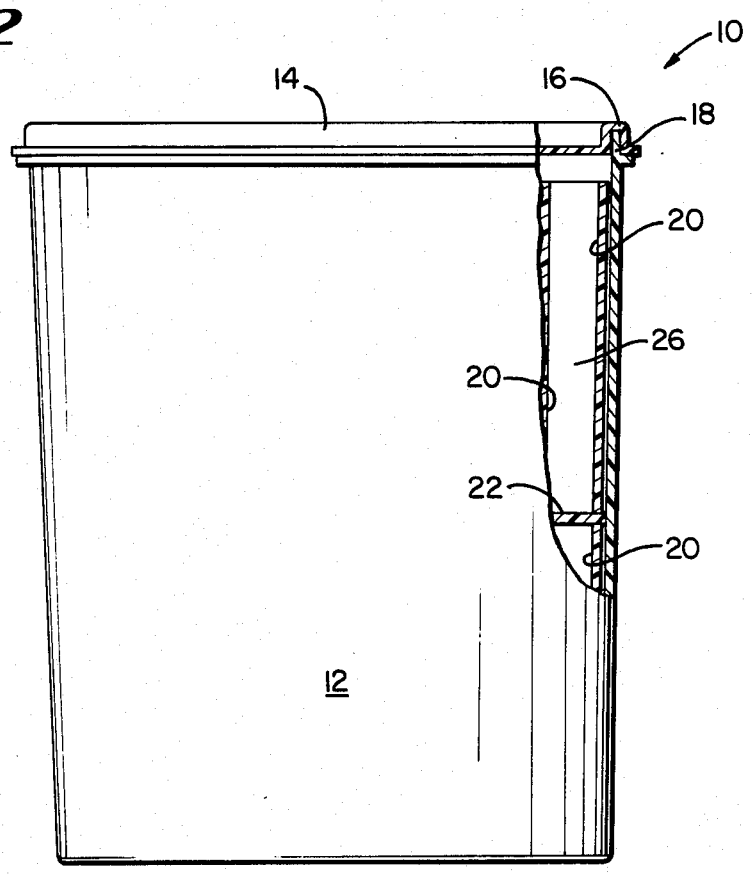
FIG. 2 is a front elevation in partial cross section of the ice maker and container of FIG. 1.
Figure 3:
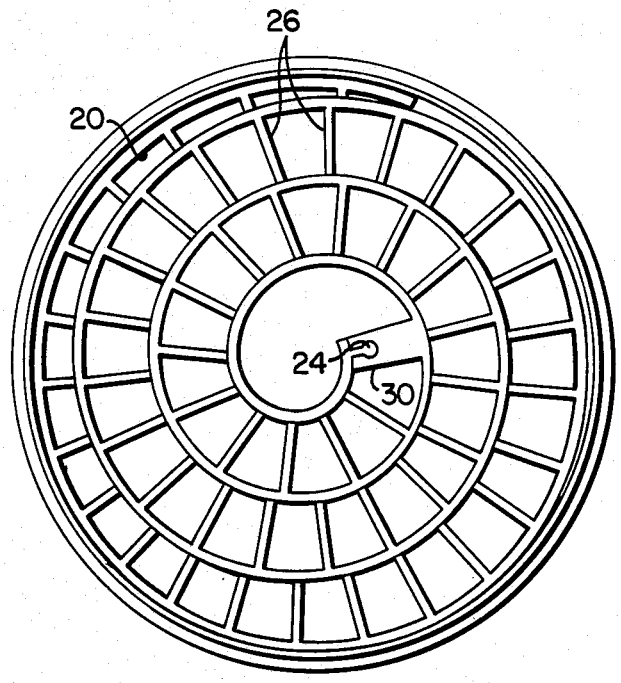
FIG. 3 is a top plan view of the ice maker and container of FIG. 1 with the lid removed.
Figure 7:
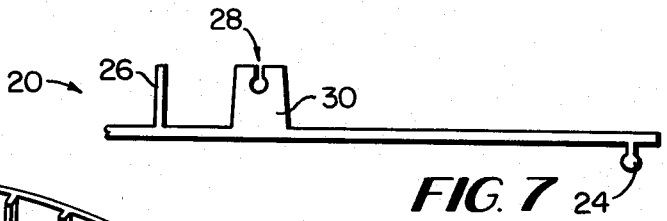
FIG. 7 is a plan view showing a portion of the inner end of a coiled strip in an uncoiled condition.
Figure 6:
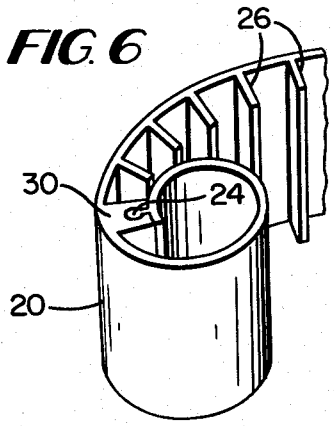
FIG. 6 is a perspective view of the inner end of a coiled strip showing the interlocking flange construction.

As shown in detail in FIGS. 6 and 7, the inner end of each strip 20 is provided with a flange member 24 having a height substantially equal to that of the strip 20. The flange member 24 has an enlarged end portion along the length thereof which mates with the enlarged inner portion of a vertical notch 28 in thickened transverse rib 30 located adjacent the inner end of the strip 20 but on the opposite side thereof from the flange 24. The plastic material of which the strip 20 is constructed is sufficiently pliable and deformable to allow the flange 24 to be snapped into and out of the notch 28 and retained therein to maintain the desired contour and curve of the coiled strip 20 while being coiled for insertion into the vessel 12. The relation of the flange 24 to the rib 30 results in a curvature that will allow the coiled strip 20 to be coiled generally about the central vertical axis of the vessel 12 in concentric arrangement therewith, when the strip 20 is placed within the vessel 12 in a horizontal position as shown in FIGS. 1–3.

Figure 4:
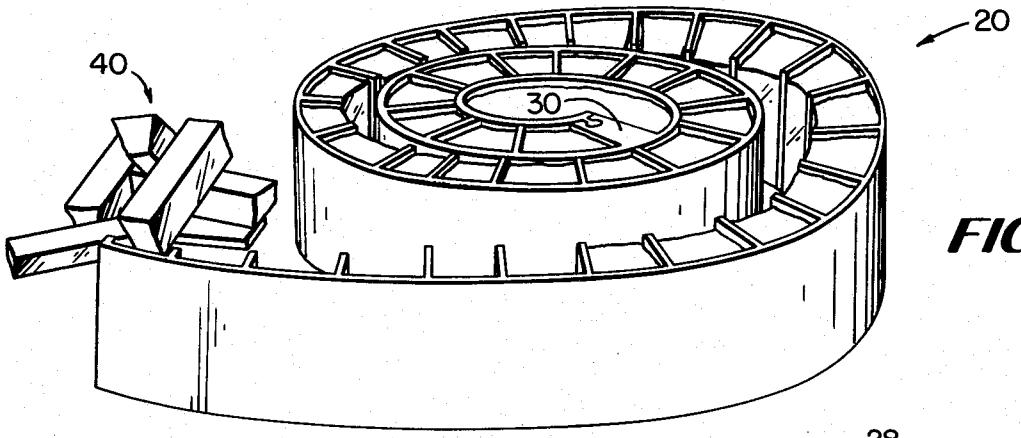
FIG. 4 is a perspective view of a coiled strip member employed with the ice maker and container of FIG. 1.
Figure 5:
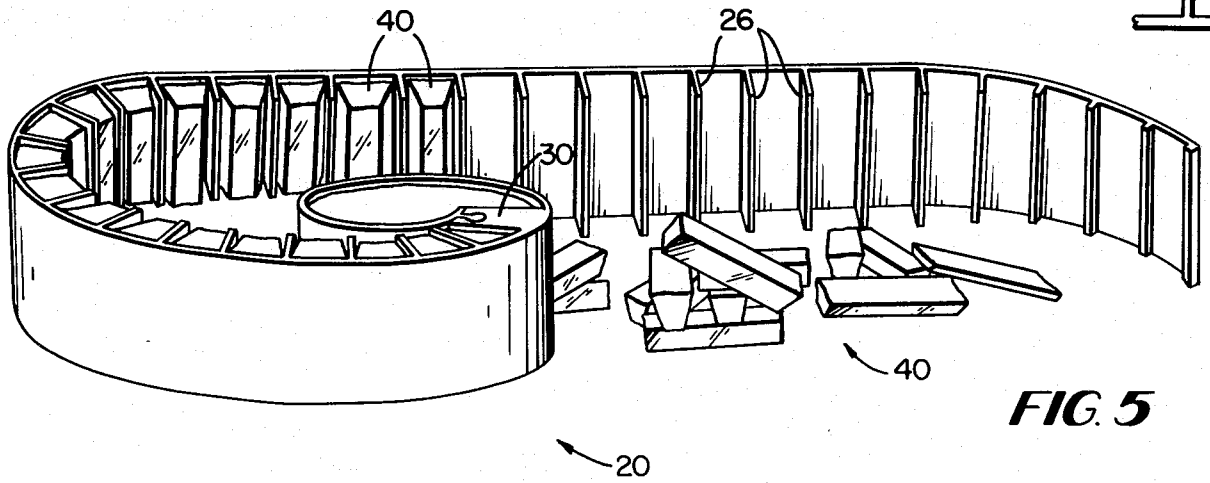
FIG. 5 is a perspective view similar to FIG. 4, but with the coiled strip having been further uncoiled.

As shown in FIGS. 4 and 5, a plurality of transverse fins or ribs 26 extend outwardly in a generally perpendicular direction from a common side of each coiled strip 20. Each rib 26 has a height equal to that of the strip 20. As shown in the drawings, the ribs 26 are preferably of varying length as measured outwardly from the strip 20, being of decreasing length from the inner end of the coiled strip 20 to the outer end to assist in providing the desired overall circular contour for fitting within the cylindrical vessel 12. It is, however, within the scope of the invention to utilize a coiled strip 20 having all ribs 26 of uniform length, as the ribs 26 are sufficiently pliable to conform to the circular contour of the vessel 12.

The coiled strips 20 may be constructed in various sizes depending on the desired size of the ice cubes 40 and other factors such as the amount of freezer space available. Thus by varying such dimensions as the height of the strip 20, the distance between ribs 26 or the length of the ribs 26, the size of the resulting ice cubes 40 will vary accordingly. The length of the strip 20 as well as the length of the ribs 26 should be selected so that the strip 20, when coiled, will fit snugly in a horizontal position within the vessel 12.

In one embodiment of the invention, a bucket-shaped vessel 12 was employed, having a diameter at its upper end of about 7 inches, a diameter at its lower end of about 6¼ inches and a height of about 7 inches. In this embodiment, a coiled strip 20 having a length of about 3 feet 6½ inches and a height of about 2¼ inches was employed. The rib 26 at the inner end of the strip 20 had a length of about ¾ inch and the length of the ribs 26 decreased uniformly along the length of the strip 20 with the rib 26 at the outer end of the strip 20 having a length of about ¼ inch. The interval between ribs 26 was uniformly about 1⅛ inch.

It is within the scope of the invention to use one coiled strip 20 or a plurality of such strips 20 in a layered configuration within the vessel 12. It is also within the scope of the invention to utilize the coiled strip 20 without the flange member 24 and thickened rib 30. In such an embodiment, the strip 20 will be coiled tightly about its inner end and the strip 20 will have a curvature which is generally concentric with respect to the central vertical axis of the vessel 12.

In the use of the ice maker and container 10 of the present invention, a coiled strip 20 is inserted into the vessel 12 so that the coiled strip 20 rests in horizontal position on the inner bottom of the vessel 12. The vessel 12 is then filled with water to a level equal to the top surface of the strip 20. If a plurality of strips are to be employed, a partition 22 is then placed over the first strip 20 and a second coiled strip 20 is placed in horizontal position on the partition 22. Additional water is then added, up to the top of the second coiled strip 20. This procedure is repeated for as many strips 20 as are to be utilized.

When placed in a freezing space for the freezing of ice cubes, the container 10 should be placed in a vertical position in order to obtain maximum utilization of the ice making capacity. Upon removing a coiled strip 20 from the vessel 12 after completion of the freezing operation, the uncoiling of the strip 20 results in separation of the ice cubes 40 from the adjacent ribs 26, as shown in FIG. 5, so that the ice cubes 40 are easily removed from contact with the strip 20 by the application of a slight twisting motion to the strip 20.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An ice container comprising:

a vessel for holding water or ice cubes, said vessel having a central vertical axis and a bottom wall and side walls defining a container which is open only at the upper end; and at least one coiled strip positioned within said vessel, said coiled strip having a plurality of transverse planar ribs attached perpendicularly at intervals along the length of said strip, said strip being in a generally horizontal position with the curvature of the coils of said strip being generally concentric with the central vertical axis of said vessel.

2. The device of claim 1 wherein said transverse ribs are of varying length as measured outwardly from the strip.

3. The device of claim 2 wherein said transverse ribs decrease uniformly in length from the inner end to the outer end of the coiled strip.

4. The device of claim 1 including a pair of said coiled strips separated by a horizontal plate member.

5. The device of claim 1 wherein said ribs are attached at uniform intervals along the length of said strip.

6. The device of claim 1 wherein said ribs are of a height equal to that of said strip.

7. The device of claim 1 further including a flange member located adjacent the inner end of said coiled strip, said flange member having a portion thereof capable of interlocking with a notch located in a rib mounted on said strip to assist in maintaining the strip in the coiled configuration.

8. The device of claim 1 further including a lid for said vessel and means for releasably securing said lid to the vessel.

9. The device of claim 1 wherein said coiled strip and transverse ribs are integrally molded of polyethylene.

10. An ice container comprising:

a vessel for holding water or ice cubes, said vessel having a central vertical axis; and a pair of coiled strips positioned within said vessel, each coiled strip having a plurality of transverse ribs attached at intervals along the length of said strip, each strip being in a generally horizontal position with the curvature of the coils of said strip being generally concentric with the central vertical axis of said vessel, said pair of coiled strips being separated by a horizontal plate member.

11. An ice container comprising:

a vessel for holding water or ice cubes, said vessel having a central vertical axis; and at least one coiled strip positioned within said vessel, said coiled strip having a plurality of transverse ribs attached at intervals along the length of said strip, one of said ribs having a notch therein, said strip being in a generally horizontal position with the curvature of the coils of said strip being generally concentric with the central vertical axis of said vessel, and wherein a flange member is located adjacent the inner end of said coiled strip, said flange member having a portion thereof capable of interlocking with said notch located in a rib mounted on said strip to assist in maintaining the strip in the coiled configuration.

12. An ice container comprising:

a vessel for holding water or ice cubes, said vessel having a central vertical axis; and at least one coiled strip positioned within said vessel, said coiled strip having a plurality of transverse ribs attached at intervals along the length of said strip, said coiled strip and transverse ribs being integrally molded of polyethylene, said strip being in a generally horizontal position with the curvature of the coils of said strip being generally concentric with the central vertical axis of said vessel.

* * * * *